US009267326B2

(12) United States Patent
Gomaa et al.

(10) Patent No.: US 9,267,326 B2
(45) Date of Patent: Feb. 23, 2016

(54) DRIVE ASSISTED ROLLER ASSEMBLY FOR ROLLING DOOR

(71) Applicants: Ashraf Gomaa, Stony Brook, NY (US); Oscar A. Escobar, Glendale, NY (US); Andrew C. Lambridis, Dix Hills, NY (US)

(72) Inventors: Ashraf Gomaa, Stony Brook, NY (US); Oscar A. Escobar, Glendale, NY (US); Andrew C. Lambridis, Dix Hills, NY (US)

(73) Assignee: McKeon Rolling Steel Door Company, Inc., Bellport, NY (US)

( * ) Notice: Subject to any disclaimer, the term of this patent is extended or adjusted under 35 U.S.C. 154(b) by 0 days.

(21) Appl. No.: 14/258,808

(22) Filed: Apr. 22, 2014

(65) Prior Publication Data

US 2014/0311689 A1 Oct. 23, 2014

Related U.S. Application Data

(60) Provisional application No. 61/814,674, filed on Apr. 22, 2013.

(51) Int. Cl.
*E05D 15/16* (2006.01)
*E06B 9/58* (2006.01)
*E06B 9/70* (2006.01)

(52) U.S. Cl.
CPC .. *E06B 9/581* (2013.01); *E06B 9/70* (2013.01)

(58) Field of Classification Search
CPC ..... E06B 9/15; E06B 9/18; E06B 9/171; E06B 9/70; E06B 2009/1505; E06B 2009/155; E06B 2009/1566
See application file for complete search history.

(56) References Cited

U.S. PATENT DOCUMENTS

| | | | | | |
|---|---|---|---|---|---|
| 705,553 | A | * | 7/1902 | Blake | 160/133 |
| 949,789 | A | * | 2/1910 | Wilson | 160/235 |
| 1,827,433 | A | | 10/1931 | Kendall | |
| 1,908,634 | A | | 5/1933 | Kendall | |
| 2,183,495 | A | | 12/1939 | Laufersweiler | |
| 2,839,135 | A | * | 6/1958 | Anderson | 160/133 |
| 3,850,465 | A | * | 11/1974 | Hill et al. | 292/231 |
| 3,878,879 | A | | 4/1975 | Manns | |
| 4,126,173 | A | * | 11/1978 | Theuerkauff | 160/229.1 |
| 4,194,549 | A | | 3/1980 | Lovgren | |
| 4,811,777 | A | | 3/1989 | Chretien | |
| 5,040,843 | A | * | 8/1991 | Russell et al. | 296/98 |
| 5,484,007 | A | * | 1/1996 | Rejc | 160/133 |
| 5,722,476 | A | | 3/1998 | Lujan | |
| 5,758,705 | A | * | 6/1998 | Wagner et al. | 160/310 |
| 6,123,139 | A | | 9/2000 | Kalempa | |

(Continued)

FOREIGN PATENT DOCUMENTS

DE 196 00 951 7/1997

*Primary Examiner* — Katherine Mitchell
*Assistant Examiner* — Abe Massad
(74) *Attorney, Agent, or Firm* — Cozen O'Connor

(57) ABSTRACT

A coupling for a door/curtain includes a plurality of coupling mechanisms affixed to ends of slats of the door/curtain. Each coupling mechanism includes a roller mounting bracket having a first roller arranged at an upper portion of the roller mounting bracket, and an extending portion, oriented at approximately 90 degrees with respect to the upper portion of the roller mounting bracket; and at least one second roller. Each second roller is rotatable around an axis perpendicular to the axis of rotation of the first roller. The first roller and the at least one second roller are arranged so as to cooperate with an outer track, inner track, roller support guide and first and second roller guides of a guide rail assembly to ensure that the door/curtain moves rollingly within the guide rail assembly even when the door/curtain is subjected to a deflecting force.

27 Claims, 10 Drawing Sheets

(56) References Cited

U.S. PATENT DOCUMENTS

| | | | | |
|---|---|---|---|---|
| 6,260,601 | B1 | 7/2001 | Thomas | |
| 6,374,897 | B1 * | 4/2002 | Liu | 160/236 |
| 6,848,734 | B1 * | 2/2005 | Mulvaney | 296/98 |
| 6,928,696 | B2 | 8/2005 | Wartman | |
| 2009/0266931 | A1 | 10/2009 | Gottschalk | |
| 2011/0265959 | A1 | 11/2011 | Frede | |
| 2012/0227914 | A1 * | 9/2012 | Coleman | 160/188 |

* cited by examiner

DRIVE ASSISTED ROLLER ASSEMBLY FOR ROLLING DOOR

CROSS-REFERENCE TO RELATED APPLICATION

This application claims the benefit of U.S. Provisional Patent Application No. 61/814,674, filed on Apr. 22, 2013, entitled "DRIVE ASSISTED ROLLER ASSEMBLY FOR ROLLING DOOR", which is hereby incorporated by reference in its entirety.

FIELD OF THE INVENTION

The disclosed embodiments relate to the field of drive systems for opening and closing rolling doors.

BACKGROUND OF THE INVENTION

Existing drive systems for rolling curtains/doors employ rollers on the door edges which engage surfaces of a track in a door guide positioned on a pair of opposite sides of a door opening. The door (curtain) may be a vertical door, which is deployed from top to bottom across a door opening; a side-coiling curtain, which is deployed sideways from left-to-right (or right-to-left) across the door opening; or a horizontal curtain, which is deployed across a horizontal opening such as, for example, a floor opening containing an escalator.

In such doors, the rollers provide a rolling engagement along the guide tracks. The door (curtain) itself is typically comprised of interlocking, loosely-fitted slats, which are locked together at their ends to maintain the slats in alignment with each other.

A problem can arise with any door traversing a significant space in that, in a high wind or other load condition, such as during a storm, a wind force against the door can create a bowed condition at an unsupported portion of the door slats, which bowing has the effect of creating an unwanted locking condition between the rollers and a surface of the tracks. Such condition can have the effect of prohibiting or restricting rolling movement of the door, depending on the wind load.

Even during regular load conditions, some movement or "play" exists between the rollers and the guide track such that the front faces of the rollers will contact the edges of the guide tracks and cause friction there-between. This condition limits the closing and opening speeds of the door.

Typically, for horizontal and side-coiling curtains, (and in instances where vertical curtains require constant operating speed), a pusher, in particular, a cog, is used to move the curtain between the opened and closed positions. In conventional systems, this is typically accomplished by positioning the cog for engagement with surfaces of the door slats to deploy and retract the curtain with respect to a coil that holds the undeployed portion of the curtain. In systems that use direct engagement of the pusher cog with the slats, wear on the slat surfaces is created and unwanted noise generated due to the striking of the cog with the slats as the curtain is moved between its opened and closed positions. To account for the wear to the slats, the metal gauge used to manufacture the slats need to be of a sufficient thickness. This adds to the cost and weight of the curtain.

SUMMARY OF THE INVENTION

It is an object of the invention to provide an improved roller assembly that overcomes the deficiencies of the prior art and that, even under heavy load conditions on the door/curtain, provides for rolling contact of the rollers in the guide track.

In accordance with one aspect of the present invention, a door assembly for covering an opening defined by at least one structural element of a building, the door assembly includes: a shutter roller rotatable about an axis of rotation; a drive mechanism configured to rotate the shutter roller about the axis of rotation; a flexible door/curtain windable on and off the shutter roller such that the flexible door/curtain is movable into retracted and extended positions by operation of the drive mechanism, the flexible door having a plurality of connected slats, each having two ends; at least one guide rail assembly positioned on at least one side of the opening and coupled to the at least one side of the opening, the at least one guide rail assembly having: (a) an outer track, coupled to the at least structural element of the building and having at least a first portion extending parallel to the flexible door/curtain, (b) an inner track, coupled to the at least structural element of the building and having at least a first portion extending parallel to the outer track and parallel to the flexible door/curtain, (c) a roller support guide, arranged fixedly between the outer track and the inner track, and (d) first and second roller guides disposed opposite one another between the inner track and the outer track, with a space maintained between the first and second roller guides; and a plurality of coupling mechanisms, each of the plurality of coupling mechanisms being affixed to ends of one or more of the plurality of slats of the door/curtain, each of the plurality of coupling mechanisms comprising: (a) at least two door/curtain mounting brackets, each door/curtain mounting bracket having: (i) a mounting surface configured to connect to a slat of the door/curtain, and (ii) an extending surface oriented at approximately 90 degrees with respect to the substantially rectangular portion, the extending surface having at least one endlock configured to maintain alignment of the slats of the door/curtain; (b) a roller mounting bracket having: (i) a first roller arranged at an upper portion of the roller mounting bracket, the first roller being rotatable around an axis perpendicular to the lengthwise direction of the slats, and (ii) an extending portion, oriented at approximately 90 degrees with respect to the upper portion of the roller mounting bracket and connected to the at least one endlock; and (c) at least one second roller, each at least one second roller being rotatable around an axis perpendicular to the axis of rotation of the first roller and connected to the at least one endlock. The first roller and the at least one second roller are arranged so as to cooperate with the outer track, inner track, roller support guide and first and second roller guides to ensure that the door/curtain moves rollingly within the guide rail assembly even when the door/curtain is subjected to a deflecting force.

In another aspect, the at least one guide rail assembly further has a mounting support configured to secure the at least one guide rail assembly to the at least one structural element of the building, at least a first end of the mounting support being configured to be affixed to the at least one structural element of the building.

In another aspect, the coupling mechanisms are linked to one another by a link coupled to posts of adjacent coupling mechanisms.

In another aspect in an assembled state of the door assembly, the at least one second roller of each of the plurality of coupling mechanisms is maintained between the first and second roller guides even when the door/curtain is subjected to a deflecting force.

In another aspect, in an assembled state of the door assembly, the door assembly is configured such that each first roller is maintained in the at least one guide rail assembly between the roller support guide and at least one of the inner track and outer track, to ensure rolling contact between the first roller and the guide rail assembly even when the door/curtain is subjected to a deflecting force.

In another aspect, the coupling mechanisms each further include a spacing mechanism arranged between the at least one second roller and one or both of the extending surface of door/curtain mounting bracket and the extending portion of the roller mounting bracket.

In another aspect, the at least one second roller includes two second rollers.

In another aspect, the drive mechanism includes a motor coupled to the shutter roller.

In another aspect, the drive mechanism includes a motor coupled to the shutter roller via an intermediate pusher cog.

In another aspect, the pusher cog has a plurality of cog teeth, and the pusher cog assists in moving the door/shutter between a closed position and an open position by engagement of the cog teeth with spaces formed in the plurality of coupling mechanisms between the second rollers.

In another aspect, the drive mechanism is contained within a drive housing.

In another aspect, the door assembly is a side coiling door assembly in which: the at least one guide rail assembly is coupled to a top side of the opening; the slats and shutter roller are arranged perpendicular to the ground; and the coupling mechanisms are arranged at top ends of the slats, proximal to the top side of the opening.

In another aspect, the drive mechanism is contained within a drive housing.

In another aspect, the drive mechanism includes a motor coupled to the shutter roller.

In another aspect, the drive mechanism includes a motor coupled to the shutter roller via an intermediate pusher cog.

In another aspect, the pusher cog has a plurality of cog teeth, and the pusher cog assists in moving the door/shutter between a closed position and an open position by engagement of the cog teeth with spaces formed in the plurality of coupling mechanisms between the second rollers.

In another aspect, the door assembly is a horizontal coiling door assembly in which: the opening comprises a hole formed in a floor of the building; the at least one guide rail assembly comprises two guide rail assemblies, one coupled to the floor at one side of the hole formed in the floor, and the other coupled to the floor at the other side of the hole formed in the floor; the slats and shutter roller are arranged parallel to the ground and perpendicular to the direction of closing and opening the door/curtain; and the coupling mechanisms are arranged at both ends of the slats, respectively proximal to the one side of the hole in the floor and to the other side of the hole in the floor.

In another aspect, the drive mechanism is contained within a drive housing.

In another aspect, the drive mechanism includes a motor coupled to the shutter roller.

In another aspect, the drive mechanism includes a motor coupled to the shutter roller via an intermediate pusher cog.

In another aspect, the pusher cog has a plurality of cog teeth, and the pusher cog assists in moving the door/shutter between a closed position and an open position by engagement of the cog teeth with spaces formed in the plurality of coupling mechanisms between the second rollers.

In another aspect, the door assembly is a vertical coiling door assembly in which: the opening is a hole formed in a wall of the building; the at least one guide rail assembly comprises two guide rail assemblies, one coupled to one side of the hole formed in the wall, and the other coupled to the other side of the hole formed in the wall; the slats and shutter roller are arranged perpendicular to the ground and perpendicular to the direction of closing and opening the door/curtain; and the coupling mechanisms are arranged at both ends of the slats, respectively proximal to the one side of the hole in the wall and to the other side of the hole in the wall.

In another aspect, the drive mechanism is contained within a drive housing.

In another aspect, the drive mechanism includes a motor coupled to the shutter roller.

In another aspect, the drive mechanism includes a motor coupled to the shutter roller via an intermediate pusher cog.

In another aspect, the pusher cog has a plurality of cog teeth, and the pusher cog assists in moving the door/shutter between a closed position and an open position by engagement of the cog teeth with spaces formed in the plurality of coupling mechanisms between the second rollers.

In another aspect, the motor is coupled directly to the shutter roller by a belt or chain drive configuration.

In accordance with a second aspect of the present invention, a coupling is provided for a door assembly for covering an opening defined by at least one structural element of a building, the door assembly having: a shutter roller rotatable about an axis of rotation; a drive mechanism configured to rotate the shutter roller about the axis of rotation; a flexible door/curtain windable on and off the shutter roller such that the flexible door/curtain is movable into retracted and extended positions by operation of the drive mechanism, the flexible door having a plurality of connected slats, each having two ends; at least one guide rail assembly positioned on at least one side of the opening and coupled to the at least one side of the opening, the at least one guide rail assembly having: (a) an outer track, coupled to the at least structural element of the building and having at least a first portion extending parallel to the flexible door/curtain, (b) an inner track, coupled to the at least structural element of the building and having at least a first portion extending parallel to the outer track and parallel to the flexible door/curtain, (c) a roller support guide, arranged fixedly between the outer track and the inner track, and (d) first and second roller guides disposed opposite one another between the inner track and the outer track, with a space maintained between the first and second roller guides. The coupling includes: a plurality of coupling mechanisms, each of the plurality of coupling mechanisms being affixed to ends of one or more of the plurality of slats of the door/curtain. Each of the plurality of coupling mechanisms includes: (a) at least two door/curtain mounting brackets, each door/curtain mounting bracket having: (i) a mounting surface configured to connect to a slat of the door/curtain, and (ii) an extending surface oriented at approximately 90 degrees with respect to the substantially rectangular portion, the extending surface having at least one endlock configured to maintain alignment of the slats of the door/curtain; (b) a roller mounting bracket having: (i) a first roller arranged at an upper portion of the roller mounting bracket, the first roller being rotatable around an axis perpendicular to the lengthwise direction of the slats, and (ii) an extending portion, oriented at approximately 90 degrees with respect to the upper portion of the roller mounting bracket and connected to the at least one endlock; and (c) at least one second roller, each at least one second roller being rotatable around an axis perpendicular to the axis of rotation of the first roller and connected to the at least one endlock. The first roller and the at least one second roller are arranged so as to cooperate with the outer track, inner track, roller support guide and first and second roller guides to ensure that the door/curtain moves rollingly within the guide rail assembly even when the door/curtain is subjected to a deflecting force.

BRIEF DESCRIPTION OF THE DRAWINGS

The above and/or other aspects and advantages will become more apparent and more readily appreciated from the following detailed description of the disclosed embodiments taken in conjunction with the accompanying drawings in which.

DETAILED DESCRIPTION

The disclosed exemplary embodiments relate to rolling steel door/curtains provided with an inventive roller coupling configured to movably secure the door/curtain to a guide track. The door/curtain according to a preferred embodiment is made of a plurality of interlocking slats which are pivotally connected to each other to provide for a rolling of the curtain about a take-up roll. Exemplary configurations of rolling steel door/curtains employing the inventive modified roller coupling will be described below in detail with regard to FIGS. 1A to 8D.

According to an exemplary embodiment, discussed herein in connection with FIGS. 1A-2B, a steel door/curtain 10, having slats 100, is affixed at at least one side to a coupling mechanism comprising a plurality of couplings 200.

Figure 1A:
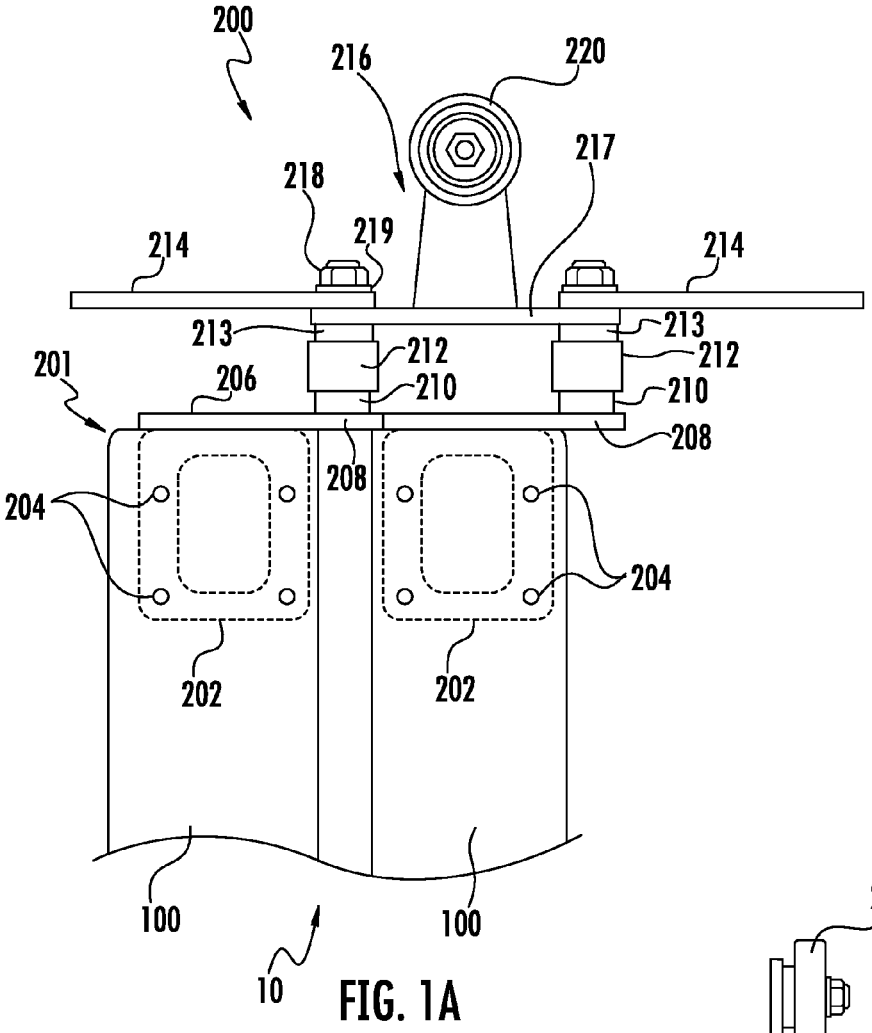
FIGS. 1A and 1B are front elevational and side views, respectively, illustrating a coupling attached to a section of a door/curtain, in accordance with an embodiment of the present invention.
Figure 1B:
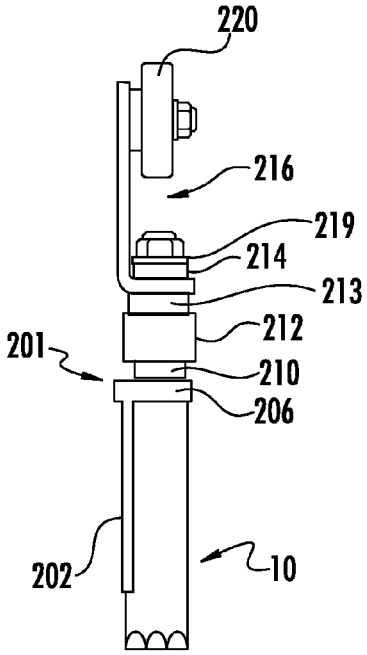
Figure 1C:
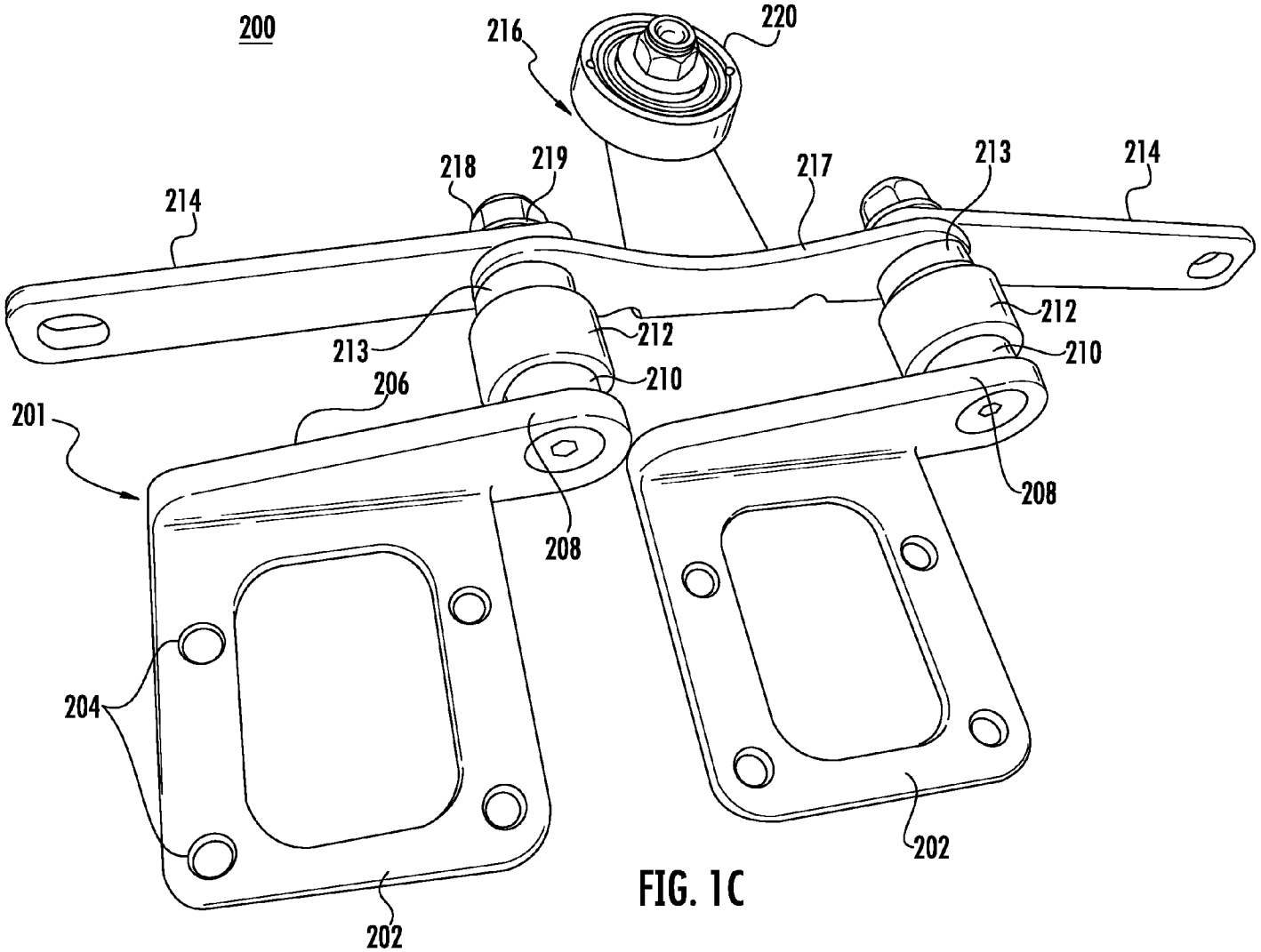
FIG. 1C is a perspective view of the coupling separate from the door/curtain to which it is shown attached in FIGS. 1A and 1B.
Figure 2B:
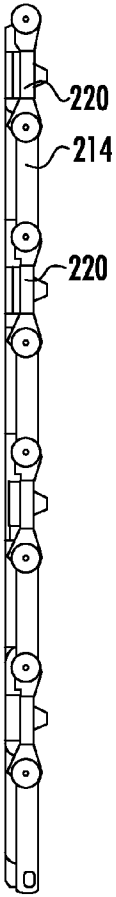
FIGS. 2A and 2B are front elevational and side views, respectively, illustrating a plurality of couplings attached to an extended section of a door/curtain, in accordance with an embodiment of the present invention.
Figure 2A:
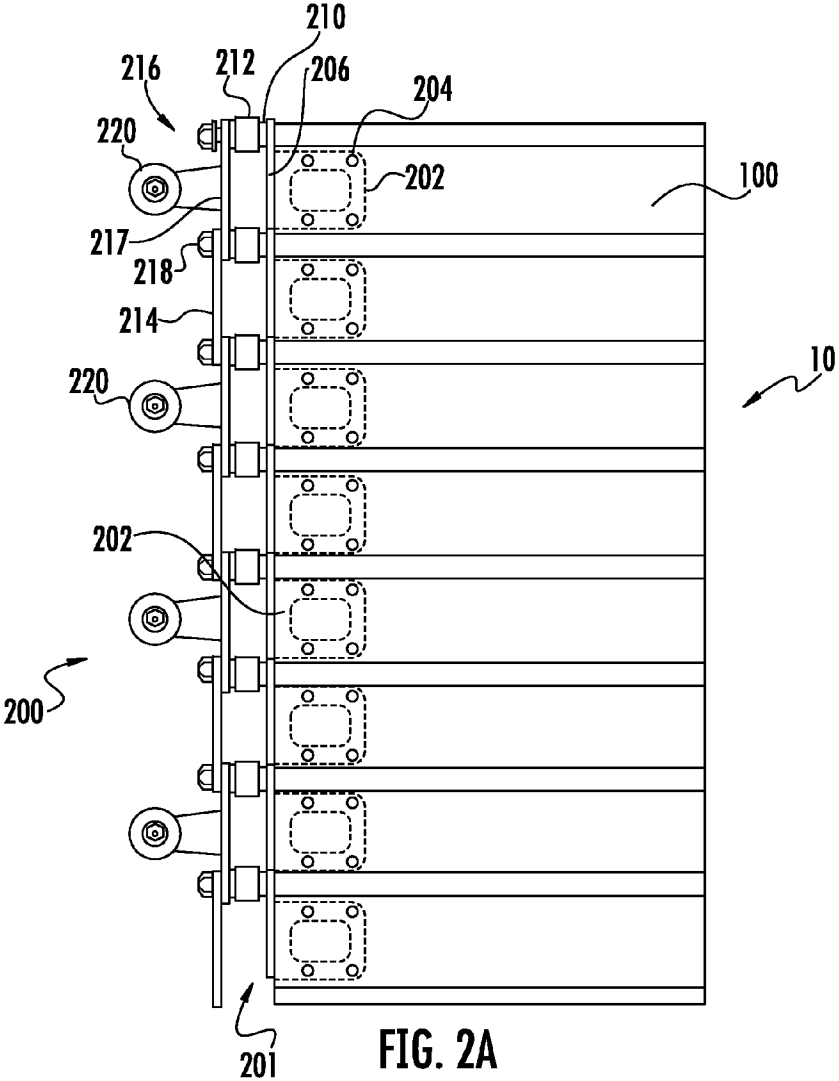

FIGS. 1A and 1B depict front and side views of a single instance of the modified coupling 200, connected to two slats 100. FIG. 1C is a perspective view of a single instance of the coupling 200, not shown as being attached to slats 100 of the door/curtain 10. FIGS. 2A and 2B depict front and side views of a plurality of such couplings 200 connected to plural slats 100 making up a door/curtain 10.

As can be seen in FIGS. 1A-2B, the slats 100 are connected to the couplings 200 at at least one end of the slat 100, by a portion of the coupling 200 that will be referred to as a curtain mounting bracket 201, having a rectangular member 202. The connection is effected preferably via a plurality of rivets or screws 204. In the views of FIGS. 1A and 2A, the curtain mounting brackets 201 are shown in phantom, to indicate that they are behind the door slats 100 in those views.

One end of the mounting bracket 201 has an extending surface 206 oriented at approximately 90° with respect to the rectangular member 202. This extending surface forms an endlock 208 to maintain alignment of adjacent slats of the curtain. Formed at each endlock 208 is a post 210 about which a traveling roller 212 is disposed and sandwiched between two spacers. In the illustrated embodiment, the spacer 213, for example an annular brass spacer, is used to maintain the spacing between the top of each travelling roller 212 and transversely extending portion of the locking roller mounting bracket 216.

The spacing between the bottom of the travelling roller 212 and the endlock 208 is preferably maintained by an annular ridge, formed in the inner wall of the travelling roller 212, abutting a ledge formed on the post 210, neither of which is visible in the figures. However, the bottom spacing is not limited to this configuration and can also be achieved, for example, by providing another annular spacer 213 in the gap between the endlock 208 and the travelling roller 212.

The locking roller mounting bracket 216 has a transversely extending portion 217 that has a hole at each end. In the assembled combination of the door/curtain 10 and the coupling 200, the posts 210 each extend through the inner opening of the travelling roller 212, the spacer 213, a hole in the transversely extending portion of the locking roller mounting bracket 216, and a receiving hole formed in a connecting link 214, as shown in FIGS. 1A and 1B, and are secured to those respective components by fasteners such as nuts 218, preferably using a washer 219 between the nut 218 and the connecting link 214.

When coupled with the door slats 100, the connecting links 214 and locking roller mounting brackets 216 are alternated such that, except for an endmost curtain locking roller mounting bracket 216, each post 210 will be fastened to adjacent connecting links 214 and locking roller mounting brackets 216, as shown, for example, in FIGS. 2A and 2B. An endmost curtain mounting bracket would not include a connecting link on the side of the locking roller mounting bracket 216 towards the end of the door/curtain 10.

The posts 210 provide a location for the traveling rollers 212 but also a spacing between the endlock 208 of each curtain mounting bracket 201 and either an end of a locking roller mounting bracket 216 or a connecting link 214.

As shown in the side view of FIG. 1B, the locking roller mounting bracket 216 has a longitudinal L-shaped cross section with one end corresponding to the transversely extending portion 217, in this cross sectional view, fastened to the post 210, and another end supporting a locking roller 220, which is rotatably mounted on the locking roller mounting bracket 216. As can be seen in FIG. 1A, each instance of the locking roller mounting bracket 216 is associated with one locking roller 220 and two traveling rollers 212. For each locking roller mounting bracket 216, the locking roller 220 and two travelling rollers 212 are oriented at 90° with respect to each other such that they engage different surfaces of a door mounting guide track 300, to be described next.

Figure 3:
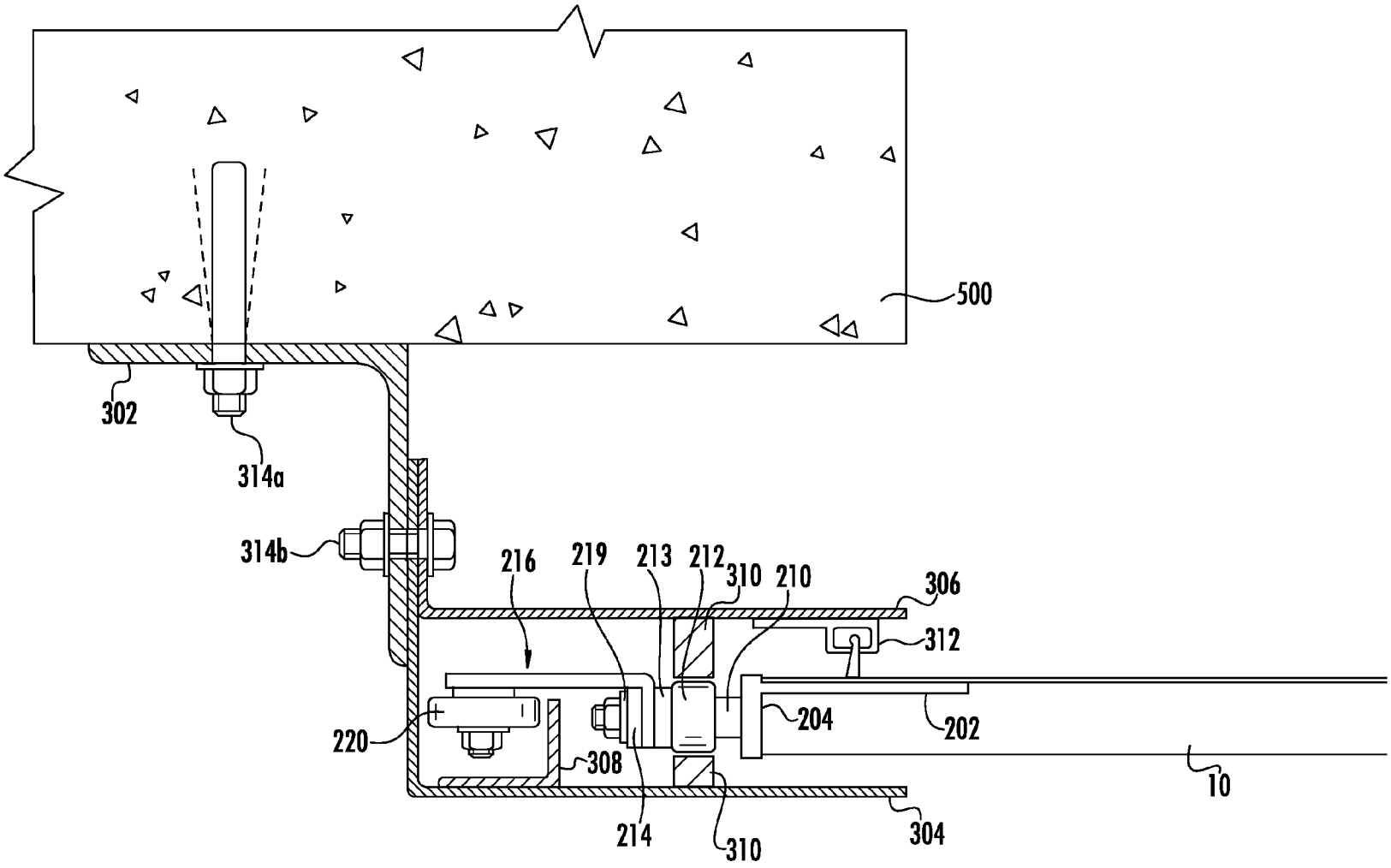
FIG. 3 is a diagram showing the couplings and door/curtain shown in FIGS. 1A to 2B in a guide track, in accordance with an embodiment of the present invention.

With reference to FIG. 3, the guide track 300 for one side of a door/curtain 10 is shown. In certain known door configurations, such as a side coiling door, the guide track 300 would only be used at one side of the door, namely the top side. In other configurations, such as a horizontal coiling door and a vertical coiling door, each side of the door/curtain 10 cooperates with a guide track 300. In cases in which a second instance of the guide track 300 and second set of couplings 200 are utilized at the other side of the door/curtain 10, the structure on the other side would be a mirror image of the structure shown in FIG. 3.

In the illustrated embodiment of FIG. 3, the guide track 300 includes a mounting/support angle 302, an outer track angle 304, an inner track angle 306, and a locking roller retaining guide 308. A pair of traveling roller guides 310 are positioned in opposing relation to each other on the outer track angle 304 and inner track angle 306 on either side of the traveling rollers 212 to provide a guide surface along which the traveling rollers 212 may roll during deployment and retraction of the door/curtain 10.

In a preferred embodiment, the travelling roller guides 310 are preferably of different heights. For example, as in the exemplary embodiment illustrated in FIG. 3, the height of the roller guide 310 on the outer track angle 304 can be made larger than the height of the roller guide 310 on the inner track angle 306. Such a configuration advantageously provides clearance for a smoke seal 312, which, in the exemplary embodiment, is also attached to the inner track angle 306 and extends toward the door/curtain 10. The smoke seal 312 functions to prevent the escape of smoke from one side of the door/curtain 10 to the other side of the door/curtain 10, which would otherwise occur through the track 300 in the absence of the smoke seal.

In the mounting configuration illustrated in FIG. 3, the locking roller 220 is positioned between the outer track angle 304 and the locking roller retaining guide 308. The locking roller 220 maintains positioning of the edges of the door/curtain 10 in the track 300 and also facilitates opening and closing of the door/curtain 10, especially during a wind load condition, which can cause a deformation of the door/curtain 10, such as a bowing of the door/curtain 10.

In such a bowed condition, for example, the locking roller 220 will contact either the locking roller retaining guide 308 or the outer track angle 304. In either event, rotational movement of the locking roller 220, and therefore the door/curtain 10 to which it is attached, along either surface is accommodated, thereby allowing the door/curtain 10 to be opened or closed, even in a high wind load condition.

In the exemplary illustrated embodiment, the mounting/support angle 302 has a L-shaped configuration and is affixed at one end to the outer track angle 304 and the inner track angle 306 by a nut and bolt combination 314*b*. The other end is preferably affixed to, e.g., a masonry wall 500, by a nut and bolt combination 314*a*.

Figure 4:
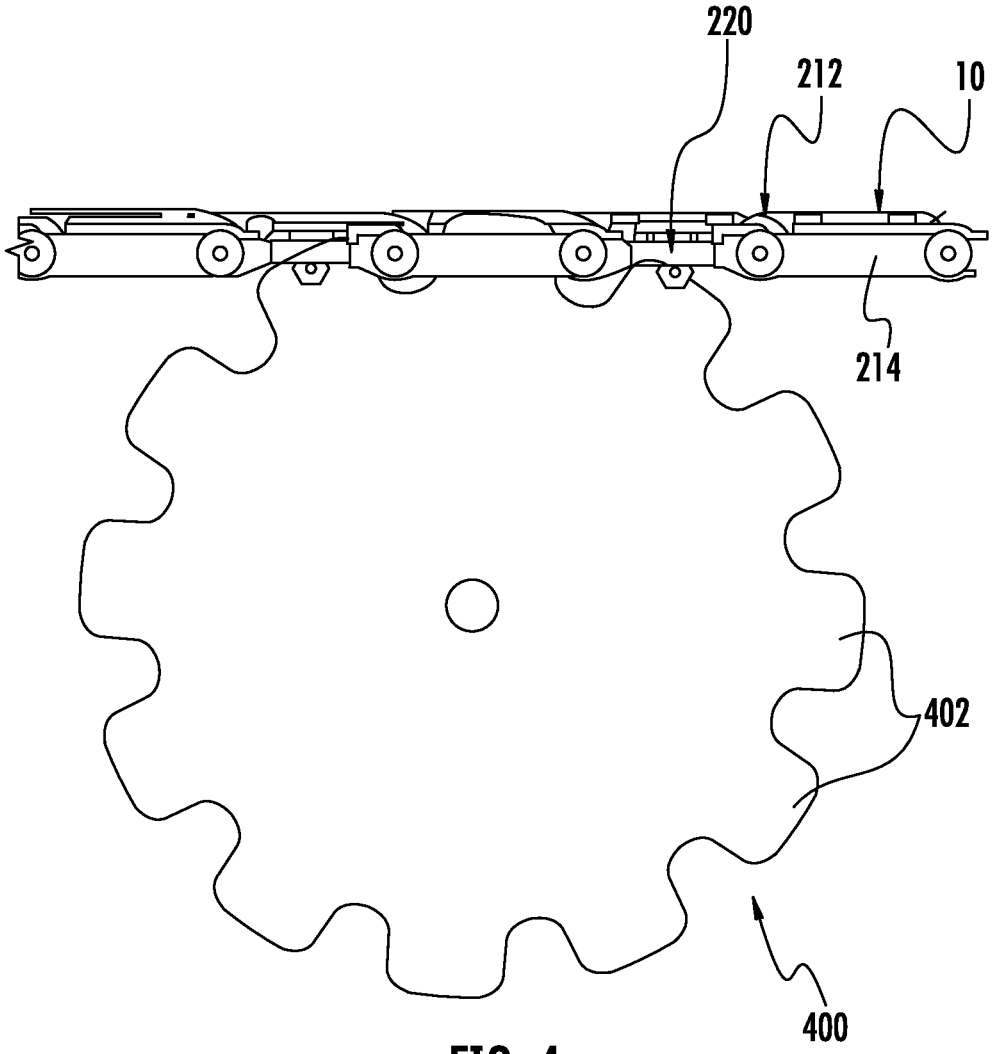
FIG. 4 is a side view illustrating the coupling and door/curtain being driven by a pusher cog, in accordance with an embodiment of the present invention.
Figure 5:
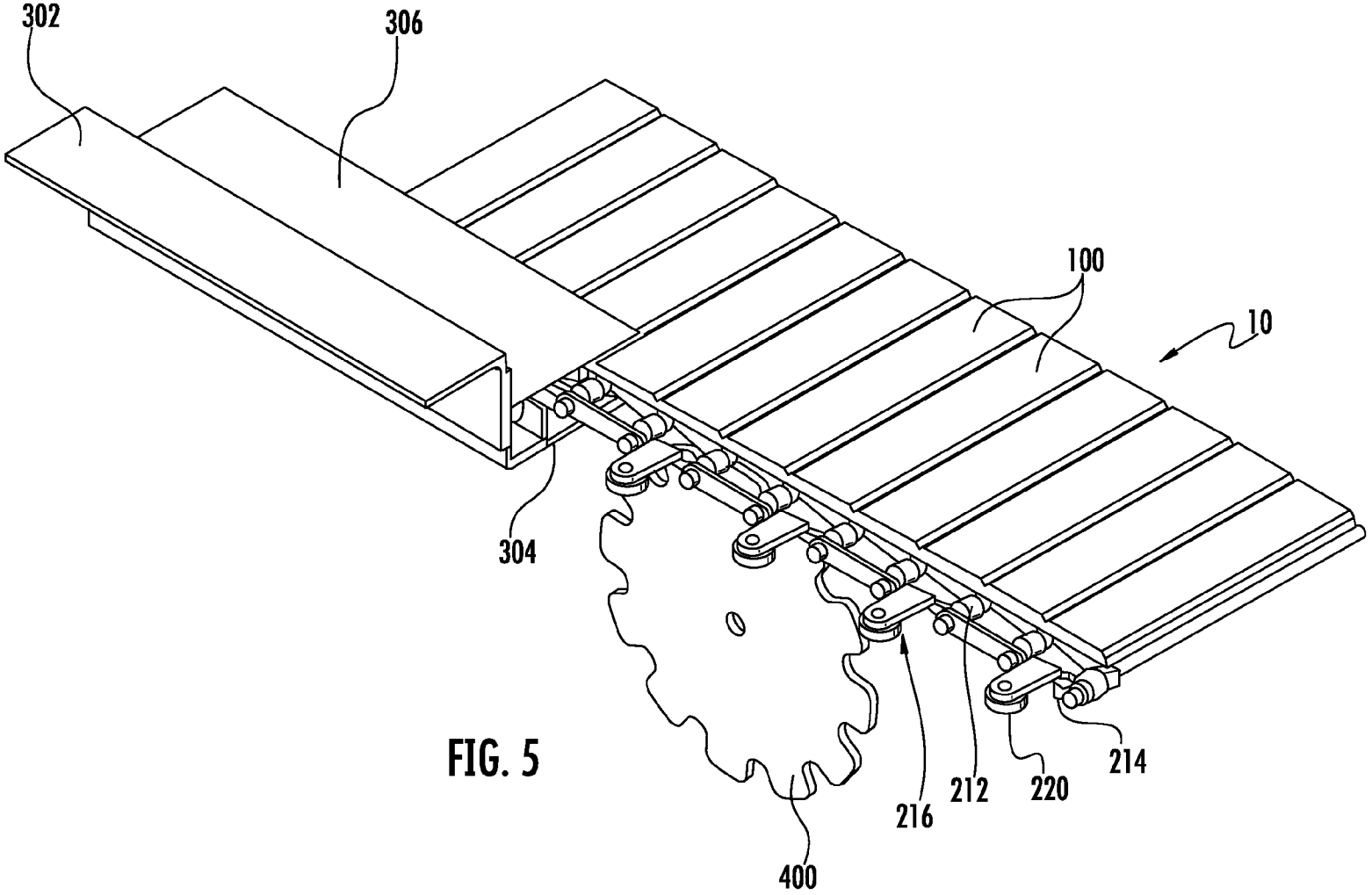
FIG. 5 is a perspective view illustrating the coupling and door/curtain being driven by a pusher cog, in accordance with an exemplary embodiment of the present invention as used in a horizontal coiling door.

FIGS. 4 and 5 illustrate how the door/curtain 10, coupling 200 and guide track 300 cooperate to allow for movement, by operation of a pusher cog 400, of the door in either a deployment direction or a retracting direction. As can be seen in FIGS. 4 and 5, the positioning of the connection links 214 provides a space, between the travelling rollers 212, into which teeth 402 of the pusher cog 400 can be received to facilitate deployment and retraction of the roller curtain without requiring contact between the cog and the slats of the curtain. While not shown in FIGS. 4 and 5, the pusher cog 400 can be driven, for example, in any known manner, e.g., either directly or indirectly, by an electronic or manual door operator via, for example, a sash chain, timing belt, or the like.

The arrangement illustrated in FIGS. 4 and 5 advantageously allows the pusher cog 400 to be positioned proximate the tracks, to engage the travelling rollers 212 in the space to drive the door/curtain 10 between the opened and closed positions. Also, as described above, the locking rollers 220 are oriented with respect to the locking roller retaining guide 308 and the outer track angle 304 so that, even during high wind conditions, which can deform the door/curtain 10 into, for example, a bowed condition, no sliding motion will occur between the door/curtain 10 and surfaces in the guide track 300. Instead, due to the advantageous configuration of the rollers, coupling, door/curtain and guide track illustrated in FIGS. 1A to 5, all engagement between the door/curtain 10 and guide track 300 are with rollers. This arrangement provides for rolling curtains to no longer be restricted in movement during a load condition.

Unlike some conventional horizontal and side-coiling curtain systems, the configuration described above with respect to FIGS. 1A to 5 does not require the pusher cog to directly engage the door slats themselves. Thus, no wear or damage is caused to the door slats. This reduces operational noise and also allows for a smaller gauge metal to be used for the door slats, thereby reducing weight. The reduced weight, in turn, allows for less stored spring energy to be used to open and close the door.

Moreover, because no pusher surface is needed on the door slats, an insulated, two-sided curtain can be used because the driving cog engages the openings but not the slats. In other words, because a slat surface is not needed to provide for engagement with the teeth of the pusher cog, a two-sided curtain having a flat surface on either curtain side can be used, with insulation sandwiched between the two sides. In addition, because there is no direct contact between the pusher cog and the slats, the door opening cycle is increased. Further, a lighter gauge metal stock can be used for the curtain slats because a less rugged curtain can now be employed as a result of the elimination of direct contact between the pusher cog and the curtain slats.

For vertical coiling curtains, an increased operational speed with a higher cycle can be achieved. Moreover, the curtain will be capable of regular opening and closing operation in high load conditions because of reduced friction between the door rollers and the track. A pusher cog can also be added to increase or regulate the opening and closing speed of the curtain.

FIGS. 6A to 6D illustrate an exemplary utilization of the inventive coupling mechanism comprising couplings 200 in the context of a side coiling door. When referring to components already described above, the same reference numeral is used as in the prior description.

As is known to those skilled in the art, side coiling doors extend and retract horizontally, with the door/curtain 10 remaining perpendicular to the ground. In such a configuration, the bottom end of the door/curtain 10 typically runs in a track formed in the floor (not shown in the drawings), using, e.g., rollers or a sliding configuration.

In the side coiling door configuration illustrated in FIGS. 6A to 6D, the top of the door/curtain 10 is fitted with couplings 200 which ride in guide track 300 in a manner substantially as shown in FIGS. 3-5. Also, while the engagement of the pusher cog 400 and the couplings 200 are shown schematically in FIGS. 6A and 6C, the engagement between the pusher cog 400 and the couplings is effected in the same manner as shown in detail in FIGS. 4 and 5.

As shown in FIGS. 6A to 6D, in the side coiling door configuration, the door/curtain 10 is opened and closed by operation of a drive unit 403, preferably enclosed in a drive unit housing 406, which, in the illustrated embodiment, extends from the floor to the top of the side coiling door. The drive unit 403 includes the pusher cog 400, having cog teeth 402, which cooperate with and engage the couplings 200 attached to the top of the door/curtain 10, to move the door/curtain 10 in the manner discussed above with respect to FIGS. 4 and 5. The pusher cog 400 is configured to rotate in one direction to un-coil the door/curtain 10 from a coil pipe 408, when closing the door/curtain 10, and in the opposite direction when retracting the door/curtain 10 to an open position. The coil pipe 408 extends in the housing 406 the entire height of the door/curtain 10. In the closed (i.e., retracted) position, the door/curtain 10 is substantially completely wrapped around the coil pipe 408 for secure storage.

The drive unit 403 also includes a motor 410 configured to set the pusher cog 400 in motion in either a clockwise or counter-clockwise direction. The motor 410 can be any standard motor that can be controlled, e.g., by a switch or other control, to drive a pusher cog 400 in the required directions, e.g., the clockwise and counter-clockwise directions.

Figure 6B:
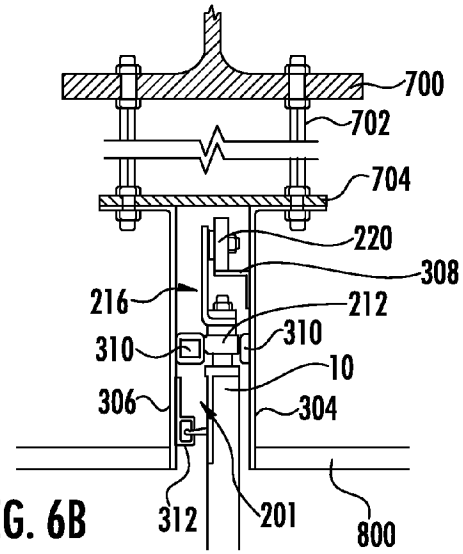
FIGS. 6A to 6D are diagrams illustrating the use of the coupling and door/curtain shown in FIGS. 1A to 2B in the context of a side coiling door.
Figure 6D:
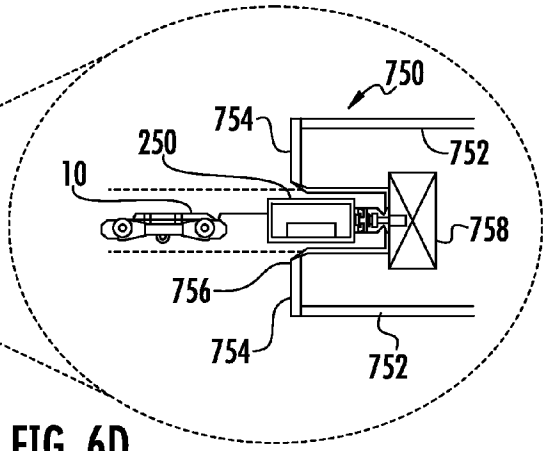
Figure 6A:
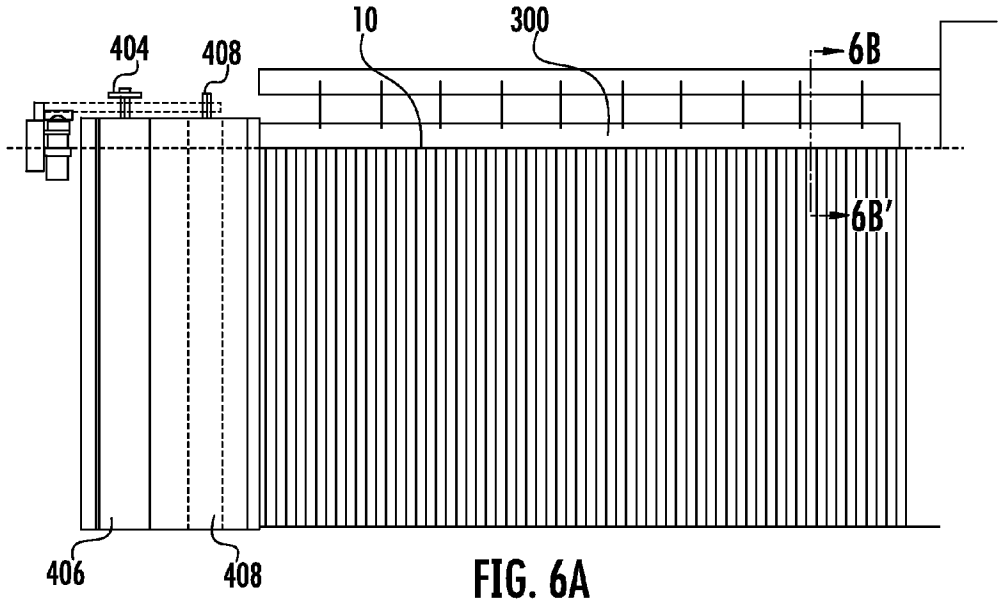

FIG. 6A is a front elevational view of the side coiling door configuration that utilizes the inventive couplings 200, and FIG. 6B is a view taken along section 6B-6B'. In the side coiling door configuration, the guide track 300 is disposed along the top of the door/curtain 10 and is affixed, in the manner shown in FIG. 6B, to a structural support 700. The structural support 700 is, for example, a laterally extending portion of the structure of the building in which the side coiling door is installed, for example a steel cross beam or a concrete member.

As can be seen in FIG. 6B, in the exemplary embodiment of the side coiling door, the rails of the guide track 300 are affixed to the door/curtain 10 and coupling 200 in substantially the same manner as shown in FIGS. 1-3. In the illustrated embodiment, the rails of the guide track 300 are affixed to the structural support 700 by a transverse structural support member 704, coupled to, and suspended from, the structural support 700 using, e.g., nut and bolt combinations 702. In particular, each of the outer track angle 304 and the inner track angle 306 are affixed by nuts and bolts to the transverse structural support member 704.

The door/curtain 10 is attached, along its top edge, to the couplings 200, in the manner discussed above in relation to FIGS. 1-3, that is, by the curtain mounting brackets 201, preferably via rivets or screws 204. As can been in FIG. 6B, the locking roller 220 rollingly contacts the locking roller retaining guide 308, which, in the case of a side coiling door, supports at least a portion of the weight of the door/curtain 10, since gravity tends to urge contact between the locking roller 220 and the locking roller retaining guide 308.

The travelling roller guides 310 are disposed at each side of the travelling rollers 212 and function to maintain the door/curtain 10 moving along the guide track 300, even in the case of a force being applied to the door/curtain 10. In a typical configuration, a finish ceiling 706 can be provided at the top of the coiling door, at a position that hides guide track 300 and the portion of the door/curtain 10 at which the door/curtain 10 attaches to the couplings 200, although the finish ceiling does not form any part of the present invention. Although not shown in FIG. 6B, the door also preferably includes a smoke seal 312, in the same manner as shown in FIG. 3, situated between the door/curtain and one rail.

Figure 6C:
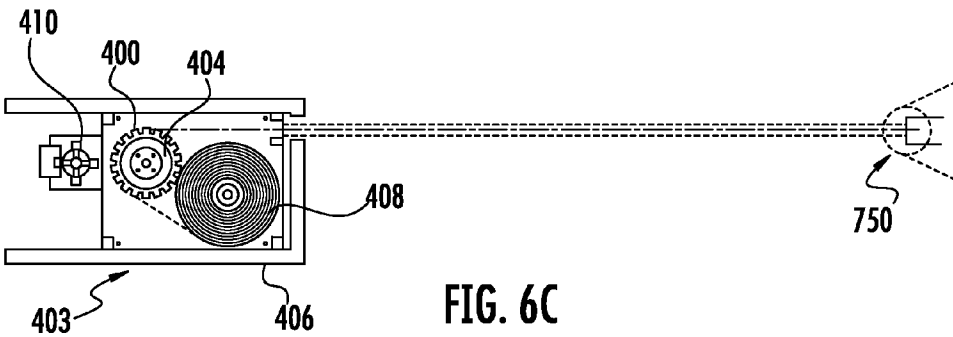

FIGS. 6C and 6D are a plan view and magnified partial view, respectively, of the side coiling door configuration. In FIG. 6C, the door/curtain 10 itself, and the rails of the guide track 300, are illustrated schematically to show the workings of the coil pipe 408, the pusher pipe 404 and the pusher cog 400 in the drive unit housing 406, which has already been described above.

At the right side of FIG. 6C, the furthest extending portion of the door/curtain 10 in the closed position is shown in relation to a side wall reception unit 750 that receives the leading edge of the door/curtain. A detailed view of this portion of FIG. 6C is shown in the magnified view of FIG. 6D.

In particular, in a preferred embodiment, in order to provide a secure connection of the leading edge of the door/curtain 10 with the wall, the door/curtain 10 has, at its leading edge, a leading edge unit 250 configured to lockingly engage in the side wall reception unit 750. The side wall reception unit 750 has side members 752 at right angles to a wall 754. A receiving channel 756 provides a break in the wall 754 into which the leading edge unit 250 can engage. As seen in FIG. 6D, the leading edge unit 250 is configured to lockingly engage with a support 758 that is surrounded by side wall reception unit 750.

Next, operation of a vertical coiling door will be described utilizing the inventive couplings 200. As before, elements having the same configuration as those described previously will be denoted with the same reference numerals as in the previous figures. Two variations of the vertical coiling door are described below. In the first variation, the coil of the vertical coiling door is directly driven by a motor, without the use of a pusher cog. This variation is described with reference to FIGS. 7A to 7C.

In a second variation, which is described with reference to FIGS. 7D and 7E, the motor drives a pusher cog, which cooperates with the couplings 200 to wind and unwind the door/curtain 10 onto and off of the coil pipe.

Figure 7A:
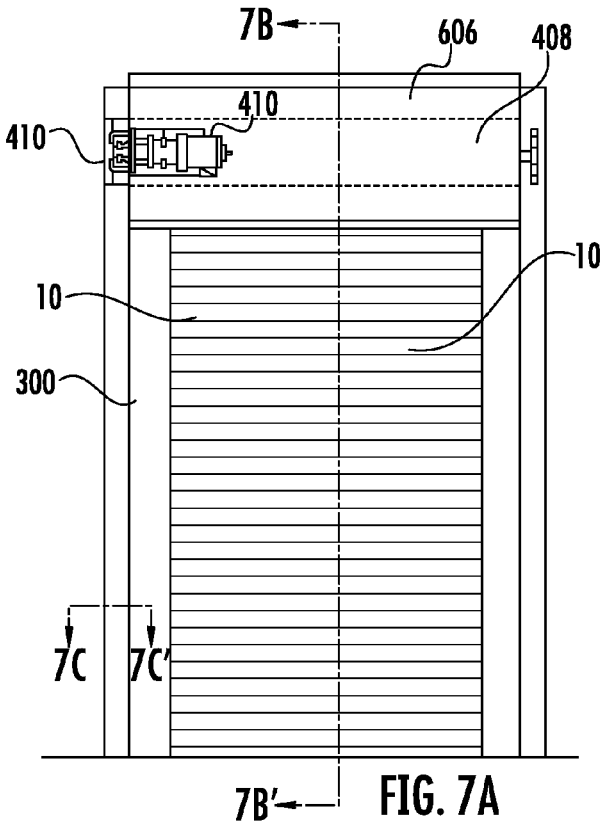
FIGS. 7A to 7C are diagrams illustrating the use of the coupling and door/curtain shown in FIGS. 1A to 2B in the context of a vertical coiling door.
Figure 7B:
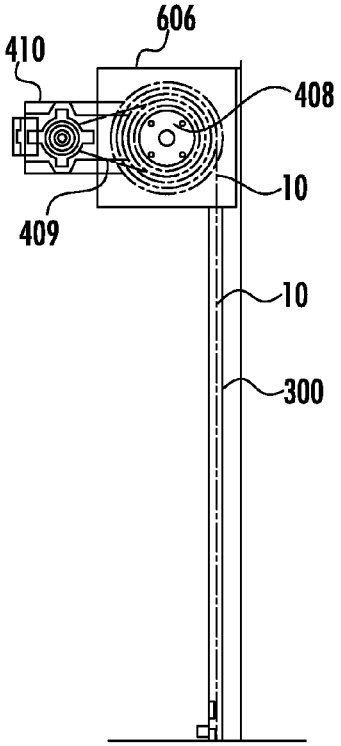
Figure 7C:
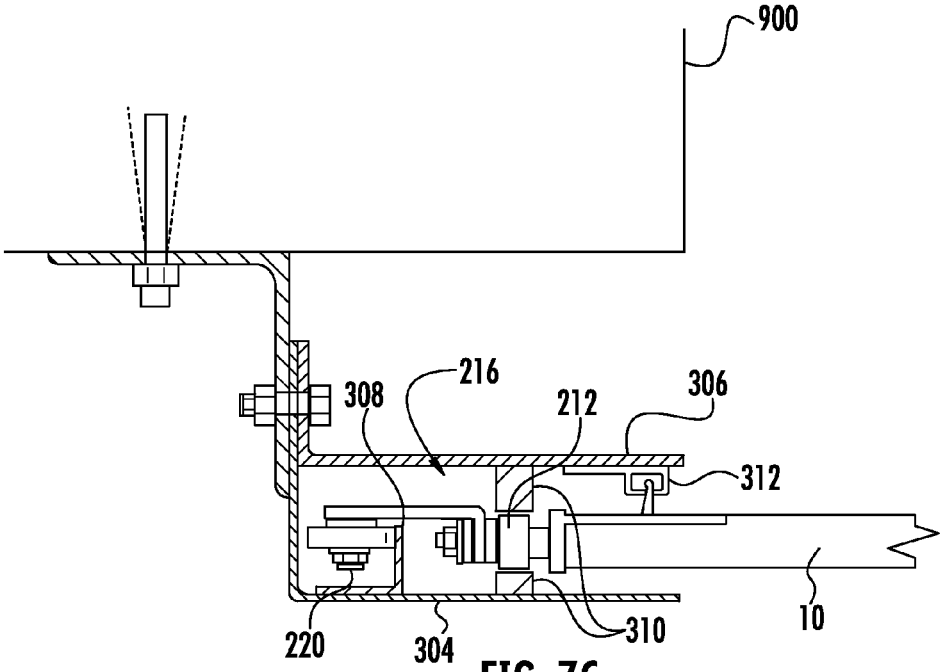
Figure 7D:
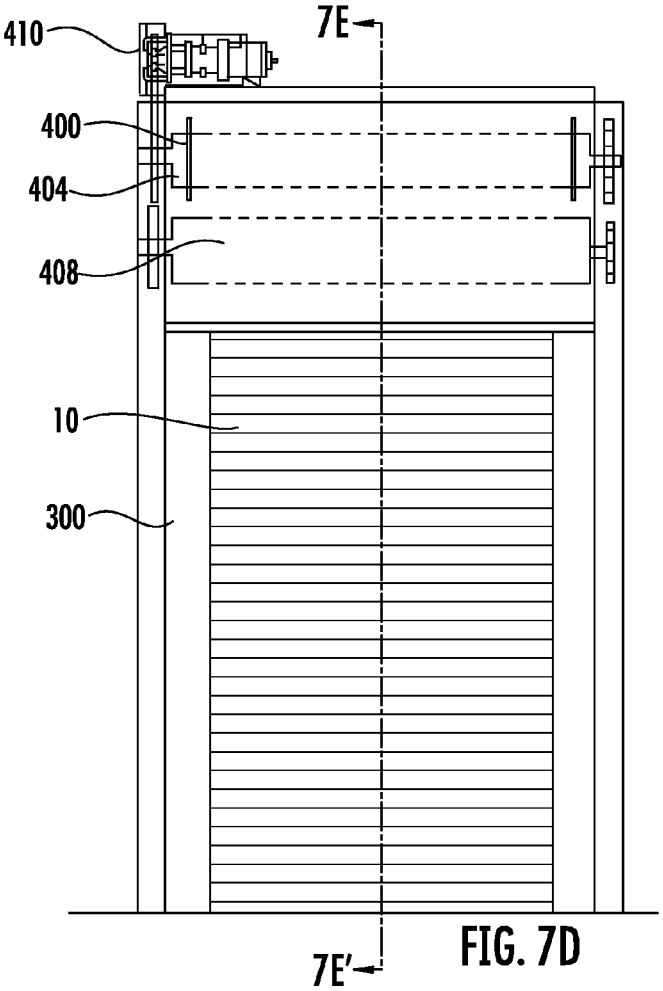
FIGS. 7D and 7E are diagrams illustrating the use of the coupling and door/curtain shown in FIGS. 1A to 2B in the context of a vertical coiling door using a pusher cog.
Figure 7E:
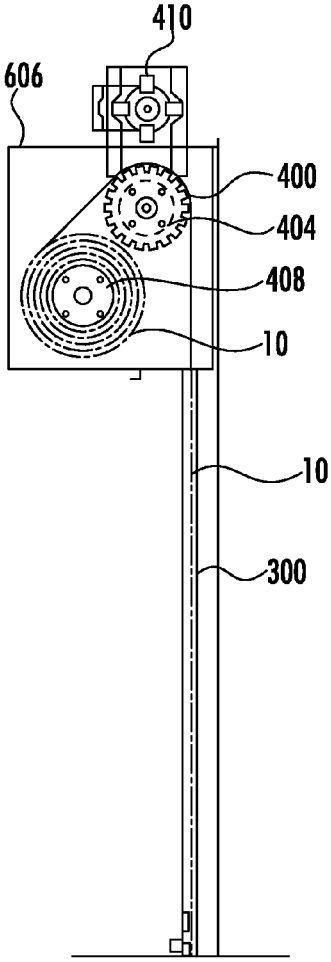

With regard to the first variation, as shown in FIGS. 7A to 7C, a vertical coiling door configuration comprises a door/curtain 10 that is wrapped around a horizontally oriented coil pipe 408 located along the top of the vertical coiling door. Guide tracks 300 extend vertically along each edge of the door/curtain 10 to form channels that permit the door/curtain 10, attached at each edge to couplings 200, to move easily up and down, from a closed to an open position, or vice versa. When the door is in the open position, the door/curtain 10 may be maintained, rolled up on the coil pipe 408, entirely within the housing 606 that surrounds the coil pipe 408. To close the door/curtain 10, rotational force is applied from the motor 410 to the coil pipe 408, for example by belt/chain 409, to unspool the wound door/curtain 10 from the coil pipe 408.

As shown in FIGS. 7A to 7C, in the vertical coiling door configuration, the door/curtain 10 is opened and closed by operation of a drive unit 604, preferably enclosed in a drive unit housing 606, which, in the illustrated embodiment, extends across the top portion of the vertical coiling door. The drive unit 604 includes a motor 410 configured to set the coil pipe 408 in motion in either a clockwise or counter-clockwise direction. The motor drives the coil pipe using a belt or chain 409. The motor 410 can be any standard motor that can be controlled, e.g., by a switch or other control, to drive the coil pipe in the required directions, e.g., the clockwise and counter-clockwise directions. The coil pipe 404 is configured to rotate in one direction to un-coil the door/curtain 10, when closing the door/curtain 10, and in the opposite direction when retracting the door/curtain 10 to an open position. The coil pipe 408 extends the entire width, from one lateral side of the door/curtain 10 to the other lateral side, along the top of the vertical coiling door. In the closed (i.e., retracted) position, the door/curtain 10 is substantially completely wrapped around the coil pipe 408 for secure storage.

FIG. 7A is a plan view of the vertical coiling door configuration that utilizes the inventive couplings 200, and FIG. 7B is a view taken along section 7B-7B'. In the vertical coiling door configuration, two guide tracks 300 are provided, one proximal to each lateral edge of door/curtain 10. Each guide track 300 is affixed, in the manner shown in FIG. 7C, to a structural support 900. The structural support 900 is, for example, a portion of the wall structure of the building in which the vertical coiling door is installed, for example a masonry wall.

The plan sectional view of FIG. 7C, shows the one side of the door/curtain 10 attached to the roller assembly of the couplings 200 in the guide track 300. A mirror image identical structure is employed at the other side of the door/curtain 10. As discussed above with respect to FIG. 3, the door/shutter 10 is attached to the couplings 200 by curtain mounting brackets 201. As in FIG. 3, the guide track 300 includes a mounting/support angle 302, an outer track angle 304, an inner track angle 306, and a locking roller retaining guide 308. A pair of traveling roller guides 310 are positioned in opposing relation to each other on the outer track angle 304 and inner track angle 306 on either side of the traveling rollers 212 to provide a guide surface along which the traveling rollers 212 may roll during deployment and retraction of the door/curtain 10. The locking roller 220 is positioned between the outer track angle 304 and the locking roller retaining guide 308. The locking roller 220 maintains positioning of the edges of the door/curtain 10 in the track 300 and also facilitates opening and closing of the door/curtain 10, especially during a wind load condition, which can cause a deformation of the door/curtain 10, such as a bowing of the door/curtain 10.

The second variation is exactly the same as the first variation except that door/curtain 10 is moved from the closed to the open position, and vice versa, using pusher cogs 400 at either end of the housing, which engage the couplings 200 in the same manner shown in FIGS. 4 and 5. As can be seen from FIG. 7D, the housing 606 extends across the top of the vertical coiling door, but in the second variation, the housing has within it both a pusher pipe 404 and a coil pipe 408, upon which the door/curtain 10 is stored in the retracted, i.e., open door position.

In this variation, the drive unit 604 includes two pusher cogs 400, each having cog teeth 402, which cogs 400 cooperate with and engage the couplings 200 attached to both lateral sides of the door/curtain 10, to move the door/curtain 10, at each side, in the manner discussed above with respect to FIGS. 4 and 5. Preferably, in the second variation of the vertical coiling door configuration, one pusher cog 400 is disposed at each end of a pusher pipe 404. The pusher cogs 400, and the pusher pipe 404, are configured to rotate in one direction to un-coil the door/curtain 10 from a coil pipe 408, when closing the door/curtain 10, and in the opposite direction when retracting the door/curtain 10 to an open position. In all other ways, the structure of the second variation of the vertical coiling door is identical to that of the first variation and those identical elements will not be described again here.

FIGS. 8A to 8D illustrate an exemplary utilization the inventive coupling mechanism comprising couplings 200 in the context of a horizontal coiling door. When referring to components already described above, the same reference numeral is used as in the prior description.

A horizontal coiling door configuration is used, for example, for covering a gap in a floor, for example, one formed by an escalator. In such configuration the door/curtain 10 is oriented horizontally in a plane substantially parallel with the plane of the floor. The door/curtain 10 can, in this configuration, be opened by winding the door/curtain onto a coil pipe.

As is known to those skilled in the art, horizontal coiling doors extend and retract substantially horizontally, with all or the majority of the door/curtain 10 remaining parallel to the ground, i.e., the floor.

In the horizontal coiling door configuration illustrated in FIGS. 8A to 8D, both lateral sides of door/curtain 10 are fitted with couplings 200 that ride in respective guide tracks 300 arranged, at each lateral side of the horizontal coiling door, in a manner substantially as shown in FIGS. 3-5. Also, while the engagement of the pusher cog 400 and the couplings 200 are shown schematically in FIGS. 8A and 8C, for one side of the horizontal coiling door, the actual engagement between the pusher cog 400 and the couplings 200 is effected in the horizontal coiling door, in the same manner as shown in detail in FIGS. 4 and 5.

As shown in FIGS. 8A to 8D, in the horizontal coiling door configuration, the door/curtain 10 is opened and closed by operation of a drive unit 503, preferably enclosed in a drive unit housing 506, which, in the illustrated embodiment, extends across the floor from one side to the other side of the horizontal coiling door. The drive unit 503 includes two pusher cogs 400, each having cog teeth 402, which cogs 400 cooperate with and engage the couplings 200 attached to both lateral sides of the door/curtain 10, to move the door/curtain 10, at each side, in the manner discussed above with respect to FIGS. 4 and 5. Preferably, in the horizontal coiling door configuration, one pusher cog 400 is disposed at each end of a pusher pipe 404. The pusher cogs 400, and the pusher pipe 404, are configured to rotate in one direction to un-coil the door/curtain 10 from a coil pipe 408, when closing the door/curtain 10, and in the opposite direction when retracting the door/curtain 10 to an open position. The coil pipe 408 extends the entire width, from one lateral side of the door/curtain 10 to the other lateral side. In the closed (i.e., retracted) position, the door/curtain 10 is substantially completely wrapped around the coil pipe 408 for secure storage.

The drive unit 503 also includes a motor 410 configured to set the two pusher cogs 400 in motion in either a clockwise or counter-clockwise direction. The motor 410 can be any standard motor that can be controlled, e.g., by a switch or other control, to drive the pusher cogs 400 in the required directions, e.g., the clockwise and counter-clockwise directions.

Figure 8B:
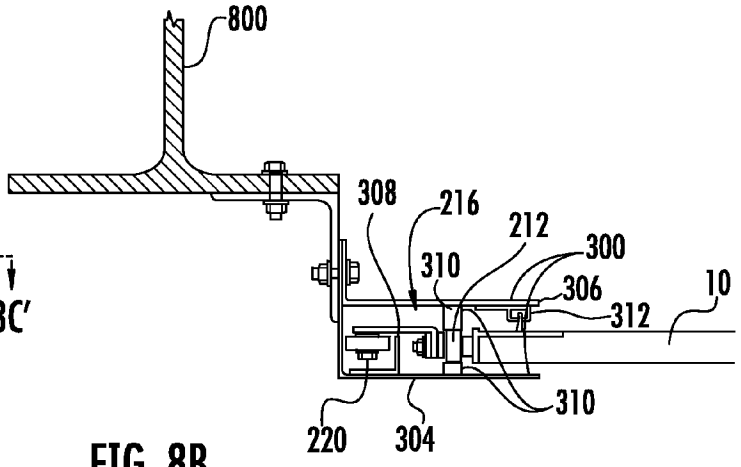
FIGS. 8A to 8D are diagrams illustrating the use of the coupling and door/curtain shown in FIGS. 1A to 2B in the context of a horizontal coiling door.
Figure 8A:
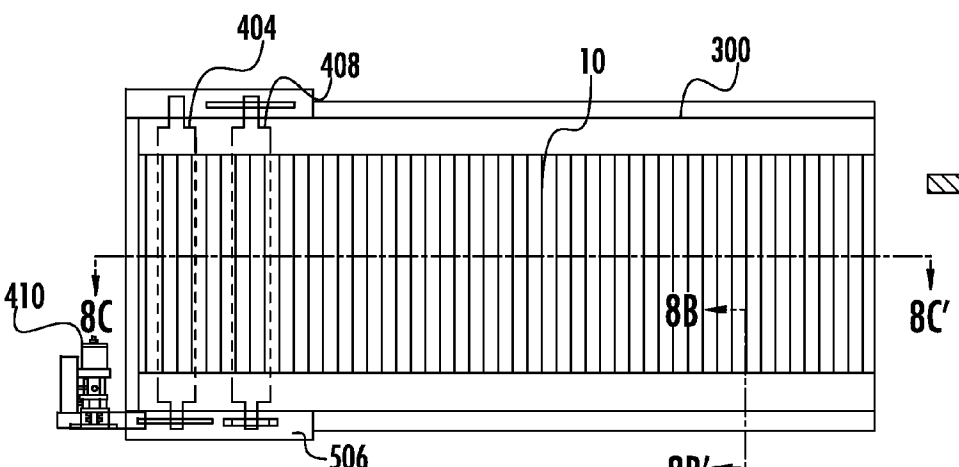

FIG. 8A is a plan view of the horizontal coiling door configuration that utilizes the inventive couplings 200, and FIG. 8B is a view taken along section 8B-8B'. In the horizontal coiling door configuration, two guide tracks 300 are provided, one proximal to each lateral edge of door/curtain 10. Each guide track 300 is affixed, in the manner shown in FIG. 8B, to a structural support 800. The structural support 800 is, for example, a downwardly extending portion of the floor structure of the building in which the horizontal coiling door is installed, for example a steel cross beam or a concrete member.

As can be seen in FIG. 8B, in the exemplary embodiment of the horizontal coiling door, the rails of the guide track 300 are affixed to the door/curtain 10 in substantially the same manner as shown in FIGS. 1-3. In the illustrated embodiment, the rails of the guide track 300 are affixed to the structural support 800 by the mounting/support angle 302, coupled to the structural support 800 using, e.g., nut and bolt combinations 314*a*. As in FIG. 3, each of the outer track angle 304 and the inner track angle 306 are affixed by nut and bolt combination 314*b* to the mounting/support angle 302. This configuration is repeated, in a mirror image, at the other lateral edge of the door/curtain 10.

The door/curtain 10 is attached, along each lateral edge, to the couplings 200, in the manner discussed above in relation to FIGS. 1-3, that is, by the curtain mounting brackets 201, preferably via rivets or screws 204. As can been in FIG. 8B the locking roller 220 is maintained between the locking roller retaining guide 308 and the outer track angle 304.

The travelling roller guides 310 are disposed at each side of the travelling rollers 212 and function to maintain the door/curtain 10 moving along the guide track 300, even in the case of a force being applied to the door/curtain 10. It is noted that in the case of a horizontal coiling door, the travelling rollers 212 will rollingly contact the lower one of the roller guides 310 under normal conditions, since the travelling rollers 212 are being urged to contact the lower roller guide by the force of gravity. Although not shown in FIG. 8B, the door also preferably includes a smoke seal 312, in the same manner as shown in FIG. 3, situated between the door/curtain and one rail.

Figure 8D:
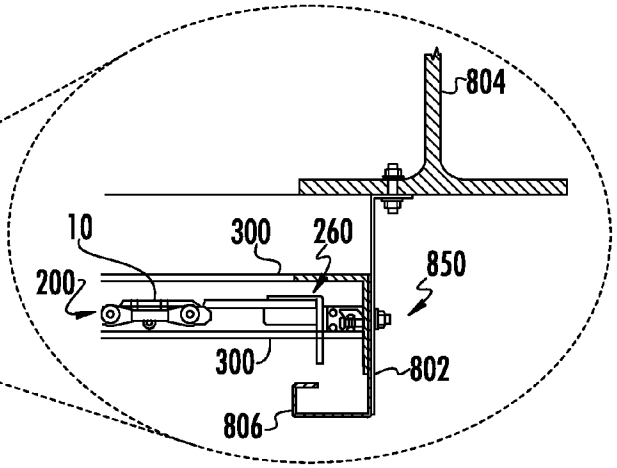
Figure 8C:
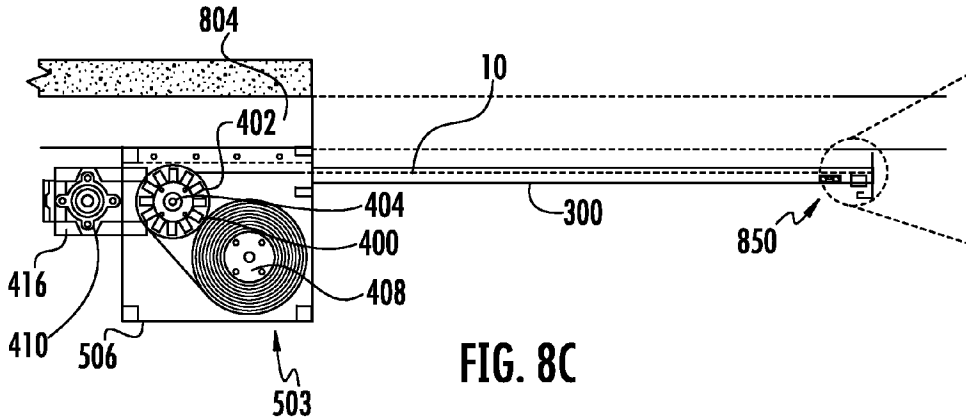

FIGS. 8C and 8D are a sectional view and magnified partial view, respectively, of the horizontal coiling door configuration. In FIG. 8C, the door/curtain 10 itself, and the rails of the guide track 300, are illustrated schematically to show the workings of the coil pipe 408, the pusher pipe 404 and the pusher cog 400 in the drive unit housing 506, which has already been described above.

At the right side of FIG. 8C, the furthest extending portion of the door/curtain 10 is shown in relation to a side wall reception unit 850 that receives the leading edge of the door/curtain 10. A detailed view of this portion of FIG. 8C is shown in the magnified view of FIG. 8D.

In particular, in a preferred embodiment, in order to provide a secure connection of the leading edge of the door/curtain 10 with the wall, the door/curtain 10 has, at its leading edge, a leading edge unit 260 configured to allow the end of the door/curtain 10 to lockingly engage in the reception unit 850. The reception unit 850, in the illustrated example, has a J-shaped member 802 that is coupled to the rails of the guide track 300 and to a support 804, which is affixed to the floor of the building. The J-shaped member 802 forms a receiving channel 806 into which the leading edge unit 260 can lockingly engage with the reception unit 850 by dropping into the receiving channel 804 when the door/curtain 10 is at a point of full extraction.

Although example embodiments have been shown and described in this specification and figures, it would be appreciated by those skilled in the art that changes may be made to the illustrated and/or described example embodiments without departing from their principles and spirit.

What is claimed is:

1. A door assembly for covering an opening defined by at least one structural element of a building, the door assembly comprising:

a shutter roller rotatable about an axis of rotation;

a drive mechanism configured to rotate the shutter roller about the axis of rotation;

a flexible door or curtain windable on and off the shutter roller such that the flexible door or curtain is movable into retracted and extended positions by operation of the drive mechanism, the flexible door or curtain having a plurality of connected slats, each having two ends;

at least one guide rail assembly positioned on at least one side of the opening and coupled to the at least one side of the opening, each instance of the at least one guide rail assembly having:

(a) an outer track, coupled to the at least one structural element of the building and having at least a first portion extending parallel to the flexible door or curtain, (b) an inner track, coupled to the at least one structural element of the building and having at least a first portion extending parallel to the outer track and parallel to the flexible door or curtain, (c) a roller support guide, arranged fixedly between the outer track and the inner track, and (d) first and second roller guides disposed opposite one another between the inner track and the outer track, with a space maintained between the first and second roller guides; and a plurality of coupling mechanisms, each of the plurality of coupling mechanisms being affixed to an end of one or more of the plurality of slats of the door or curtain, wherein each of the plurality of coupling mechanisms is attachable to two different slats, each of the plurality of coupling mechanisms comprising:

(a) at least two door or curtain mounting brackets, each door or curtain mounting bracket having:

(i) a mounting surface configured to connect to a slat of the door or curtain, and (ii) an extending surface oriented at approximately 90 degrees with respect to the mounting surface, the extending surface having at least one endlock configured to maintain alignment of the slats of the door or curtain;

(b) a roller mounting bracket having:

(i) a first roller arranged at an upper portion of the roller mounting bracket, the first roller being rotatable around an axis perpendicular to the lengthwise direction of the slats, and (ii) an extending portion, oriented at approximately 90 degrees with respect to the upper portion of the roller mounting bracket and connected to the at least one endlock; and (c) at least two second rollers, each second roller being rotatable around an axis perpendicular to the axis of rotation of the first roller and connected to the at least one endlock, the second rollers being arranged so as to be aligned with respect to each other in a direction of door or curtain propagation and offset in relation to the first roller, wherein the first roller and the second rollers are arranged so as to cooperate with the outer track, inner track, roller support guide and first and second roller guides to ensure that the door or curtain moves rollingly within the guide rail assembly even when the door or curtain is subjected to a deflecting force.

2. The door assembly according to claim 1, the at least one guide rail assembly further having a mounting support configured to secure the at least one guide rail assembly to the at least one structural element of the building, at least a first end of the mounting support being configured to be affixed to the at least one structural element of the building.

3. The door assembly according to claim 1, the coupling mechanisms each being linkable to an adjacent one of the coupling mechanisms by a link coupled to posts of the adjacent one of the coupling mechanisms.

4. The door assembly according to claim 1, wherein, in an assembled state of the door assembly, both second rollers of each of the plurality of coupling mechanisms are maintained between the first and second roller guides even when the door or curtain is subjected to a deflecting force.

5. The door assembly according to claim 1, wherein, in an assembled state of the door assembly, the door assembly is configured such that each first roller is maintained in the at least one guide rail assembly between the roller support guide and at least one of the inner track and outer track, to ensure rolling contact between the first roller and the guide rail assembly even when the door or curtain is subjected to a deflecting force.

6. The door assembly according to claim 1, the coupling mechanisms each further comprising a spacing mechanism arranged between at least one of the two second rollers and at least one selected from the group consisting of the extending surface of the door or curtain mounting bracket and the extending portion of the roller mounting bracket.

7. The door assembly according to claim 1, wherein the drive mechanism comprises a motor coupled to the shutter roller.

8. The door assembly according to claim 7, wherein the drive mechanism comprises a motor coupled to the shutter roller via an intermediate pusher cog.

9. The door assembly according to claim 8, wherein the pusher cog has a plurality of cog teeth, and the pusher cog assists in moving the door or curtain between a closed position and an open position by engagement of the cog teeth with spaces formed in the plurality of coupling mechanisms between the second rollers.

10. The door assembly according to claim 1, wherein the drive mechanism is contained within a drive housing.

11. The door assembly according to claim 1, wherein the door assembly is a side coiling door assembly in which:

the at least one guide rail assembly is coupled to a top side of the opening;

the slats and shutter roller are arranged perpendicular to the ground; and the coupling mechanisms are arranged at top ends of the slats, proximal to the top side of the opening.

12. The door assembly according to claim 11, wherein the drive mechanism is contained within a drive housing.

13. The door assembly according to claim 12, wherein the drive mechanism comprises a motor coupled to the shutter roller.

14. The door assembly according to claim 13, wherein the drive mechanism comprises a motor coupled to the shutter roller via an intermediate pusher cog.

15. The door assembly according to claim 14, wherein the pusher cog has a plurality of cog teeth, and the pusher cog assists in moving the door or curtain between a closed position and an open position by engagement of the cog teeth with spaces formed in the plurality of coupling mechanisms between the second rollers.

16. The door assembly according to claim 1, wherein the door assembly is a horizontal coiling door assembly in which:

the at least one structural element comprises a floor of the building and the opening comprises a hole formed in the floor of the building;

the at least one guide rail assembly comprises two guide rail assemblies, one coupled to the floor at one side of the hole formed in the floor, and the other coupled to the floor at the other side of the hole formed in the floor;

the slats and shutter roller are arranged parallel to the ground and perpendicular to the direction of closing and opening the door or curtain; and the coupling mechanisms are arranged at both ends of the slats, respectively proximal to the one side of the hole in the floor and to the other side of the hole in the floor.

17. The door assembly according to claim 16, wherein the drive mechanism is contained within a drive housing.

18. The door assembly according to claim 17, wherein the drive mechanism comprises a motor coupled to the shutter roller.

19. The door assembly according to claim 18, wherein the drive mechanism comprises a motor coupled to the shutter roller via an intermediate pusher cog.

20. The door assembly according to claim 19, wherein the pusher cog has a plurality of cog teeth, and the pusher cog assists in moving the door or curtain between a closed position and an open position by engagement of the cog teeth with spaces formed in the plurality of coupling mechanisms between the second rollers.

21. The door assembly according to claim 1, wherein the door assembly is a vertical coiling door assembly in which:

the opening is a hole formed in a wall of the building;

the at least one guide rail assembly comprises two guide rail assemblies, one coupled to one side of the hole formed in the wall, and the other coupled to the other side of the hole formed in the wall;

the slats and shutter roller are arranged perpendicular to the ground and perpendicular to the direction of closing and opening the door or curtain; and the coupling mechanisms are arranged at both ends of the slats, respectively proximal to the one side of the hole in the wall and to the other side of the hole in the wall.

22. The door assembly according to claim 21, wherein the drive mechanism is contained within a drive housing.

23. The door assembly according to claim 22, wherein the drive mechanism comprises a motor coupled to the shutter roller.

24. The door assembly according to claim 23, wherein the drive mechanism comprises a motor coupled to the shutter roller via an intermediate pusher cog.

25. The door assembly according to claim 24, wherein the pusher cog has a plurality of cog teeth, and the pusher cog assists in moving the door or curtain between a closed position and an open position by engagement of the cog teeth with spaces formed in the plurality of coupling mechanisms between the second rollers.

26. The door assembly according to claim 23, wherein the motor is coupled directly to the shutter roller by a belt or chain drive configuration.

27. A coupling for a door assembly for covering an opening defined by at least one structural element of a building, the door assembly having: a shutter roller rotatable about an axis of rotation; a drive mechanism configured to rotate the shutter roller about the axis of rotation; a flexible door or curtain windable on and off the shutter roller such that the flexible door or curtain is movable into retracted and extended positions by operation of the drive mechanism, the flexible door or curtain having a plurality of connected slats, each having two ends; at least one guide rail assembly positioned on at least one side of the opening and coupled to the at least one side of the opening, each instance of the at least one guide rail assembly having: (a) an outer track, coupled to the at least one structural element of the building and having at least a first portion extending parallel to the flexible door or curtain, (b) an inner track, coupled to the at least one structural element of the building and having at least a first portion extending parallel to the outer track and parallel to the flexible door or curtain, (c) a roller support guide, arranged fixedly between the outer track and the inner track, and (d) first and second roller guides disposed opposite one another between the inner track and the outer track, with a space maintained between the first and second roller guides, the coupling comprising:

a plurality of coupling mechanisms, each of the plurality of coupling mechanisms being affixed to an end of one or more of the plurality of slats of the door or curtain, wherein each of the plurality of coupling mechanisms is attachable to two different slats, each of the plurality of coupling mechanisms comprising:

(a) at least two door or curtain mounting brackets, each door or curtain mounting bracket having:

(i) a mounting surface configured to connect to a slat of the door or curtain, and (ii) an extending surface oriented at approximately 90 degrees with respect to the mounting surface, the extending surface having at least one endlock configured to maintain alignment of the slats of the door or curtain;

(b) a roller mounting bracket having:

(i) a first roller arranged at an upper portion of the roller mounting bracket, the first roller being rotatable around an axis perpendicular to the lengthwise direction of the slats, and (ii) an extending portion, oriented at approximately 90 degrees with respect to the upper portion of the roller mounting bracket and connected to the at least one endlock; and (c) at least two second rollers, each second roller being rotatable around an axis perpendicular to the axis of rotation of the first roller and connected to the at least one endlock, the second rollers being arranged so as to be aligned with respect to each other in a direction of door or curtain propagation and offset in relation to the first roller, wherein the first roller and the second rollers are arranged so as to cooperate with the outer track, inner track, roller support guide and first and second roller guides to ensure that the door or curtain moves rollingly within the guide rail assembly even when the door or curtain is subjected to a deflecting force.

* * * * *